US008210629B2

(12) United States Patent
Adkins et al.

(10) Patent No.: US 8,210,629 B2
(45) Date of Patent: Jul. 3, 2012

(54) METHOD FOR MEASURING INK FLOW RATE IN AN INKJET PRINTHEAD

(75) Inventors: Christopher Alan Adkins, Lexington, KY (US); Eric David Langevin, Lexington, KY (US); Jason Todd McReynolds, Georgetown, KY (US); Robert Henry Muyskens, Lexington, KY (US); Nicholas Jon Post, Lexington, KY (US); Kent Lee Ubellacker, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 417 days.

(21) Appl. No.: 12/469,085

(22) Filed: May 20, 2009

(65) Prior Publication Data

US 2010/0295882 A1 Nov. 25, 2010

(51) Int. Cl.
*B41J 2/195* (2006.01)

(52) U.S. Cl. ..... 347/7; 347/17; 347/23

(58) Field of Classification Search ..... 347/5, 7, 347/14, 17, 19, 23
See application file for complete search history.

(56) References Cited

U.S. PATENT DOCUMENTS 4,860,027 A * 8/1989 Ozelis et al. ..... 347/7
5,699,090 A * 12/1997 Wade et al. ..... 347/7

* cited by examiner

*Primary Examiner* — Lam S Nguyen

(57) ABSTRACT

A method of determining the state of a printhead/cartridge in a thermal inkjet printer. An inkjet printhead undergoes a jetting operation in which a jetting frequency is selected and a corresponding steady state printhead temperature is known. The printhead is heated to the steady state temperature. Then the printhead is jetted with all nozzles for a predetermined period of time. Temperature samples from the printhead are obtained and the change in the printhead temperature for a short period of time is used to determine a slope in the temperature change. From the slope of printhead temperature changes, the ink flow rate through the printhead can be determined. The flow rate of ink through the printhead can be used to determine the various states of the printhead, including out of ink, clogged, deprimed, a taped printhead, etc.

13 Claims, 5 Drawing Sheets

| COLOR (100% NOZZLES) | | MONO (100% NOZZLES) | |
|---|---|---|---|
| FREQUENCY | TEMPERATURE | FREQUENCY | TEMPERATURE |
| 1000 | 36 | 1000 | 32 |
| 2000 | 45 | 2000 | 36.5 |
| 3000 | 50 | 3000 | 37.5 |
| 4000 | 51.5 | 4000 | 39.5 |
| 5000 | 53 | 5000 | 40 |
| 6000 | 55 | 6000 | 42 |
| 7000 | 56.5 | 7000 | 43 |
| 8000 | 57.5 | 8000 | 44 |
| 9000 | 58.5 | 9000 | 44.5 |
| 10000 | 59.3 | 10000 | 46 |
| 11000 | 60.1 | 11000 | 46.5 |
| 12000 | 61 | 12000 | 47 |

*Fig. 4*

METHOD FOR MEASURING INK FLOW RATE IN AN INKJET PRINTHEAD

CROSS REFERENCES TO RELATED APPLICATIONS

None.

BACKGROUND

1. Field of the Invention
2. Description of the Related Art

Inkjet printers utilize print cartridges that provide a supply of ink for the printhead. The ink is drawn from the cartridge during printing and when depleted, the cartridge must be replaced. Often, the user of the printer is automatically advised when the ink cartridge is low on ink. Determining when an inkjet cartridge is out of ink can be a difficult undertaking. Because of the physics of the pressure regulation system, the inkjet printhead is not capable of delivering all of the ink stored in the cartridge. Therefore, there is no true out of ink condition. Rather, the condition that leads to the end of life for an inkjet printhead occurs when the fluid pressure of the cartridge can no longer be regulated at a level that allows the necessary ink flow. When the ink remaining in the pressure regulation system reaches a certain level, the pressure becomes too high to deliver ink at the expected jetting rate. Adding to the confusion over out of an ink condition is the fact that when the pressure regulation system begins to fail, initially only print images that require high flow rates will be affected by a degraded print quality. As additional ink is used, the pressure regulation system will continue to fail at lower ink flow rates until the print is degraded to the point at which the print quality is unacceptable to all users.

This same end of life phenomenon is exhibited regardless of whether the printhead is integrated into the ink cartridge or is a separate device. In systems in which the printhead is permanently (or semi-permanently) attached to the printer instead of to the cartridge, additional situations may be presented in which ink starvation can occur. In narrow flow systems, there is a requirement for the fluid system of the printhead to be primed incrementally during the printhead life. If the printhead becomes deprimed, then the starvation phenomenon will even occur during printing. In wide flow systems, it is generally not possible to prime the printhead in the printer. However, even in wide flow systems the printhead may become deprimed, which requires replacement of the printhead.

In addition to the foregoing problems, there is also the possibility that the fluid path of a permanent or semi-permanent printhead may become blocked. If the purge/prime system in the printer is not able to clear the blockage, then the printhead requires replacement. This is an expensive operation for either the customer or the manufacturer, depending on whether the printhead is still under warranty. Therefore, there is a need to determine if the printhead has a permanent fluid blockage. Unfortunately, there is no practical method used today to determine when the pressure regulation system of an inkjet printer begins to fail. What is needed is a technology that can determine when this system failure begins.

In view of the foregoing, users of inkjet printers are often confused as to whether an ink cartridge is out of ink. Frequently, ink cartridges are replaced when the ink is low, even though there is sufficient ink to continue printing, albeit at a lower print setting. However, absent this option, the efficiency of ink usage of many cartridges is underutilized. Ink cartridges used in thermal inkjet printers can become inoperable for many reasons, many of which cannot be diagnosed, and thus the cartridge is simply discarded. Ink cartridges can fail due to being clogged, deprimed or simply low on ink. In other instances, users can become frustrated after replacing an ink cartridge with a new cartridge and find the new cartridge also fails to work. In many instances, the user has failed to remove the protective tape before installing the new cartridge in the printer.

U.S. Pat. No. 5,315,316 discloses a method of detecting ink flow through a printhead. This patent requires that the initial temperature of the printhead be close to room temperature at the beginning of the test. After the printhead has completed a print job, there could be a significant amount of time needed in order for the temperature of the printhead to return to room temperature. There is no suggestion in this patent of any technique for determining if the printhead is deprimed or clogged.

U.S. Pat. No. 5,699,090 discloses an out of ink detector for a thermal inkjet printer. The technique for detecting an out of ink condition is based on setting the initial temperature of a printhead to a setting that is much higher than the printhead would reach in any jetting operation. Then, during a printing operation the temperature is measured. If the temperature remains high, then the cartridge is out of ink. If the temperature decreases, then there is ink remaining in the cartridge. Currently available inkjet printheads operate at printing temperatures approaching 70° C. Therefore, to set a temperature higher than 70° C. and to take into account variations, the temperature setting could approach about 100° C. A temperature of this magnitude could create permanent damage to the printhead.

U.S. Pat. No. 6,196,651 describes a method and apparatus for detecting the end of life of a print cartridge used in a thermal inkjet printer. The method disclosed detects an out of ink condition based on setting the initial temperature of the printhead to a predefined setting, then performing a print operation for a time period, then waiting a time period, and then measuring the temperature. If the temperature measured after the time period is greater than the initial temperature, then the cartridge is considered out of ink.

From the foregoing, it can be seen that a need exists for a technique to determine more accurately the nature of ink cartridge problems so that measures can be carried out, if possible, to remedy the same. Another need exists for an automatic assessment by the printer of specific cartridge problems so that if repairable, fewer otherwise usable ink cartridges will not be unnecessarily discarded. Yet another need exists for a technique to determine when the ink in a cartridge is low, so that even if the ink flow rate will not support a high print setting, a lower print setting can be used in order to utilize the remaining ink until depleted. Other needs exist for inkjet printers that can determine when the ink cartridges are clogged, whether depriming of the cartridge has occurred, and whether other nonfunctional states of the printhead exist.

SUMMARY OF THE INVENTION

During normal printing operations, the nozzle heaters in the semiconductor substrate of the printhead chip are operated to cause nucleation of the ink and the corresponding jetting of a droplet of ink. At the same time, the ink that flows through the nozzles functions acts as a coolant and removes heat from the printhead substrate. There is an equilibrium reached in which the heat added to the printhead by the nozzle heaters equals the heat removed by the ink flowing through the printhead. When this equilibrium point is reached, if the ink flow decreases because of clogging, depriming or an out of ink condition, then the temperature of the substrate will increase.

In one disclosed embodiment, a technique is shown to determine if a flow rate of ink has decreased. The temperature of the printhead is set to the predefined steady state jetting temperature (SSJT). The printhead is then jetted at a constant known rate for a predefined period of time, and then the temperature of the printhead substrate is measured. A determination is then made if the printhead temperature has increased, and if an increase in the printhead temperature is found, then the reduction in the ink flow rate is proportional to the rate of increase in temperature.

Also described herein are processes for using these techniques to determine the flow rate of ink from a cartridge, and thus though the printhead. From this, assessments are made as to whether the printhead remains taped, whether nozzles are clogged, whether the cartridge is low or out of ink, and whether the cartridge has become deprimed.

BRIEF DESCRIPTION OF THE DRAWINGS

FIG. 4 is a table of the nominal steady state jetting temperatures of a color ink printhead and a monochrome ink print head, as a function of jetting frequencies;

DETAILED DESCRIPTION

Figure 1:
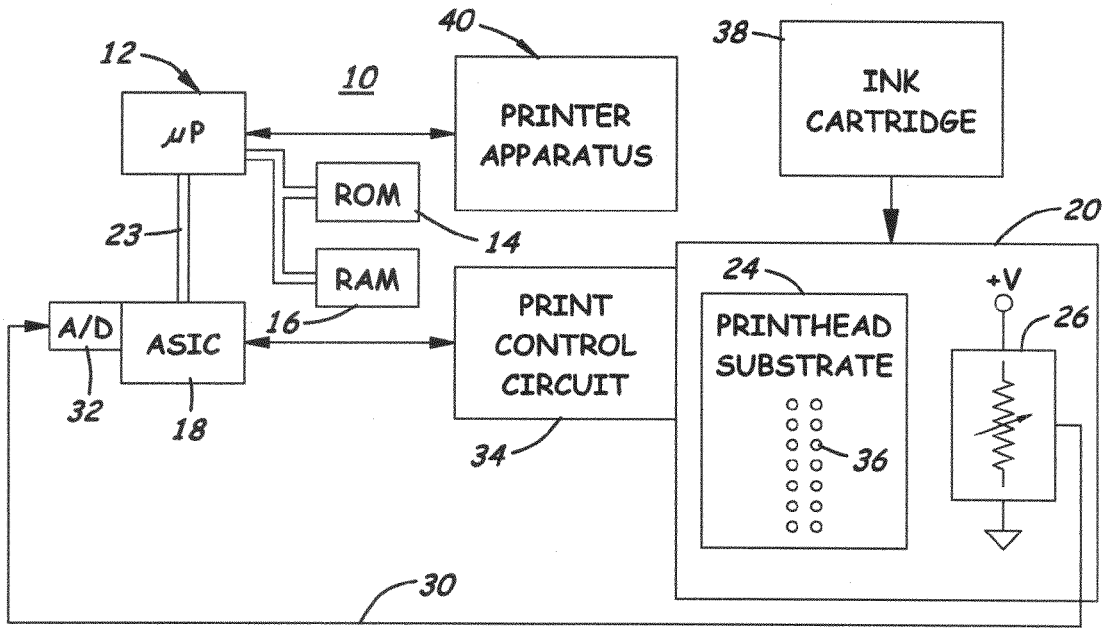
FIG. 1 is a simplified block diagram of an inkjet printer employing the features of the invention.

FIG. 1 illustrates in block diagram form the functional aspects of a thermal inkjet printer 10. The printer 10 as a whole is controlled by a programmed microprocessor 12 connected to a ROM 14 and RAM 16. The microprocessor 12 controls a controller 18 which may comprise an ASIC specially designed to control the particular type of printhead 20. The microprocessor 12 is connected to the ASIC 18 by a bus 23. The control could be a combined ASIC and microprocessor, or the controller 18 could be implemented entirely as hardware circuits. In any event, the ASIC chip 18 includes a heating algorithm for driving the print control circuit 34, which is often integrated into the printhead 20. The ASIC 18 can heat the printhead substrate 24 using non-nucleating heating (NNH) techniques. With this technique, the printhead 20 is driven in a manner to effectively cause the nozzle heaters to heat the surrounding substrate, but not enough to nucleate the ink in the nozzle cavities and cause jetting of the ink. Other substrate heating techniques can be employed with equal effectiveness. In any event, the temperature of the printhead substrate 24 is monitored by a sensor 26. The voltage generated by the temperature sensor 26 is coupled on line 30 to an A/D converter 32 to digitize the temperature signals. The digital samples of the sensor voltage can then be processed by the microprocessor 12, and/or the ASIC chip 18.

The print control 34 is controlled by the ASIC 18 to cause desired nozzles 36 of the printhead 20 to jet respective droplets of ink therefrom and form a character on a print medium. In practice, the ASIC 18 transmits address information to the printhead 20 to select the particular nozzles 36 that should be active to print a character. A particular address effectively causes a nozzle heater in the semiconductor substrate, below a specific nozzle 36, to become rapidly heated to nucleate the ink therein. The intense and concentrated heat causes a bubble to form in the ink cavity of the nozzle, whereupon a droplet of ink is jetted from an opening in a nozzle plate onto the print medium. The printhead 20 receives liquid ink from a supply, such as a replaceable cartridge 38. As noted above, the printing of images by the printhead 20 causes the printhead substrate 24 to become heated.

In practice, the print control 34 is integrated into the semiconductor substrate 24 so that a single semiconductor structure is involved in the printhead 20. While the other printer apparatus of the inkjet printer 10 is involved during the printing of images on a print medium, such apparatus is not necessary to the realization of the features of the invention. Nevertheless, shown in FIG. 1 is the other printer apparatus 40, which may include a carrier control for moving the print head 20 laterally across the print medium, a carriage control to scroll the print medium, paper feed control, etc. Also not shown is a spit cup located at an extreme position to the left or right of the carriage. A maintenance procedure can be programmed in the microprocessor 12 to carryout maintenance on the printhead 20. When placed in a maintenance mode, the printhead 20 is moved to the extreme carriage position in front of the spit cup. Then, the printhead 20 can be operated to repeatedly jet ink from the nozzles 36 to clean the same and to remove any clogged nozzles.

As noted above, the determination of the amount of ink in the cartridge 38 before it is completely depleted can prevent substantial interrupted printing operations, at least to the extent that a user can be advised in advance. Thus, when the ink cartridge 38 does run out of ink, the user can quickly replace the used ink cartridge 38 with the new cartridge 38 and resume printing operations. Otherwise, operations can be substantially interrupted if the user has to go to the business store room to obtain a new cartridge 38, or to a nearby office supply store.

Figure 2:
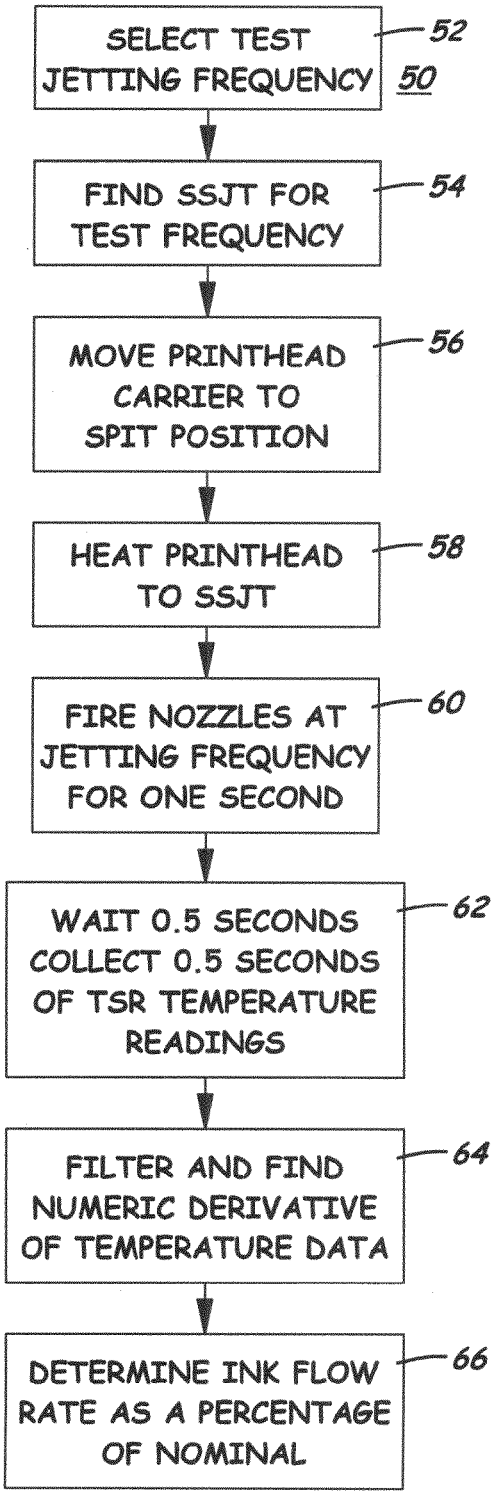
FIG. 2 is a flow chart illustrating the operations of the printer in determining a flow rate of the ink from the cartridge, to thereby determine various functional states of the printhead/cartridge.

To that end, illustrated in FIG. 2 is an algorithm 50 for determining an ink flow rate of a cartridge 38, and from such measurement various printhead and cartridge states can be found, including low and out of ink cartridge states, deprimed cartridges, clogged printheads, etc. The various algorithms can be programmed in the microprocessor 12 and carried out during a maintenance mode, or other mode instituted by the user to ascertain the operational states of the printhead 20 and the cartridge 38.

With reference to program flow block 52, the microprocessor 12 selects a test jetting frequency. A suitable jetting frequency can be selected using the table of FIG. 4. The microprocessor 12 can consult such a table to select a print frequency and determine the corresponding steady state printhead temperature when operated at such frequency. This is shown in program flow block 54. The various temperatures shown in FIG. 4 are nominal printhead temperatures that can be expected from the respective printheads when all jets are operated. As can be seen, the jetting frequency selected is generally a function of whether the printhead 20 is monochrome or color. For specific printheads, when all jets are operated, the steady state temperature of the printhead is a function of the jetting frequency. The data of FIG. 4 can be determined experimentally for particular printheads of interest. The jetting frequency with all nozzles 36 or jets operated assures that the flow of ink though the printhead 20 is substantial. As noted above, the flow of ink, and particularly the rate of ink flow, has a cooling effect on the printhead substrate 24. The temperature of the printhead 20 is a function of the flow rate of the ink which, in turn, is a function of the level of ink in the cartridge 38. This is especially true when either the ink in the cartridge 38 is reaching a low level, or the pressure regulation cannot sustain the flow rate demands, especially at high printing rates.

When the temperature of the printhead 20 is determined for a selected jetting frequency, the microprocessor 12 causes the printhead 20 to be moved to the spit cup position. This is shown in program flow block 56.

Processing then proceeds to program flow block 58, where the printhead 20 is heated by non-nucleating heating techniques to the predefined steady state temperature. The temperature of the printhead 20 is monitored with the sensor 26. The corresponding temperature data is coupled to the microprocessor 12, via the A/D converter 32, to determine the printhead temperature during the temperature sampling periods. Eventually, the microprocessor 12 determines that the printhead temperature has stabilized and has reached the selected steady-state jetting temperature (SSJT). If substrate heating techniques other than non-nucleating heating methods are used, then the substrate heater is turned off.

As soon as the printhead 20 reaches the steady state jetting temperature, the system starts jetting all of the nozzles 36 in a burst using default fire pulses, at the selected test frequency. A default fire pulse is a fire pulse having a default duration that assures nucleation of the ink. The default duration of a fire pulse is generally longer than necessary in order to cause a nozzle to jet a droplet of ink. The printhead nozzles 36 are all jetted for one second. This is shown in program flow block 60. Other time periods can be utilized.

After a half second of temperature settle time, the printer 10 collects samples of printhead temperatures for a half second. This is shown in program flow block 62. As noted above, the temperature samples from the sensor 26 are coupled to the A/D converter 32, converted to corresponding digital signals, and transferred to the microprocessor 12 via the ASIC 18.

As noted in program flow block 64, the printhead substrate temperature data is processed by the microprocessor 12 by filtering the temperature samples using a conventional n-point running average filter. The microprocessor 12 then takes a numeric derivative of the filtered data and averages the derivative.

In program flow block 66, the ink flow rate is determined as a percentage of a nominal flow rate. If there is a rise in printhead temperature during the test jetting period, then the ink flow in the printhead 20 can be considered to have decreased from the nominal flow rate. If the slope of a rise in printhead temperature is above a predefined limit, then the ink flow rate is considered to be zero. The predefined limit can be determined for printheads of a particular type by experimental means.

Figure 3:
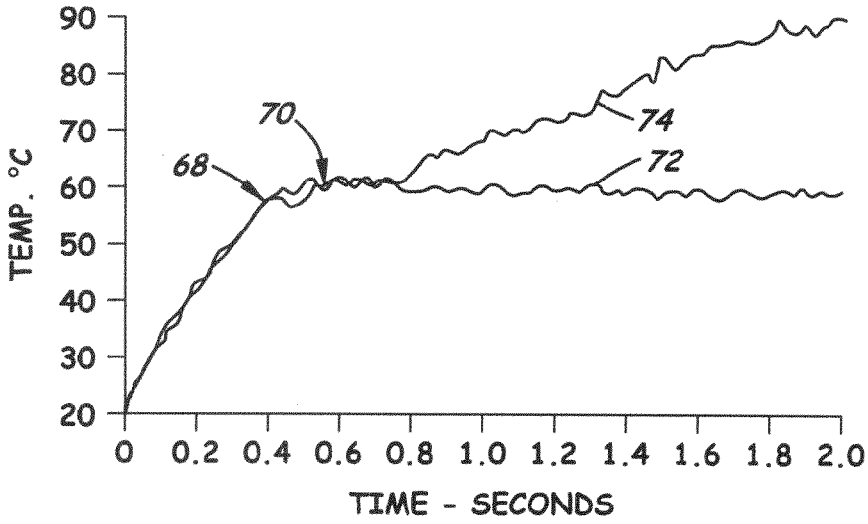
FIG. 3 graphically depicts the temperature response of a printhead with a nominal amount of ink, and another printhead that is out of ink, and the corresponding temperature slopes indicative of the same.

FIG. 3 graphically depicts the temperature responses of two printheads and associated ink cartridges that have undergone the foregoing procedures to determine the respective ink flow rates. The horizontal axis is segmented into 0.2 second intervals of time, and the vertical axis represents temperature in increments of 10° C. Reference number 68 is the time period in which the printheads are heated by the heater control 22 to the selected steady state jetting temperature. The numeral 70 indicates the commencement of the jetting of all nozzles at the selected test frequency. Reference numeral 72 indicates the half second wait period to collect temperature data for a half second for one printhead. Reference numeral 74 indicates the half second wait period to collect temperature data for a half second for the other printhead. The response indicated by numeral 74 is the printhead that is out of ink, and the response indicated by numeral 72 is the printhead that had sufficient ink remaining. The cooling effect of the ink flowing through the printhead 20 maintained the temperature thereof relatively constant, whereas the printhead 74 that was out of ink exhibited increased temperature. The slope of the change in temperature during the short jetting period is a measure of the extent of ink flow through the printhead, for whatever reason.

With this technique, a change in flow rate of the ink can be determined for any jetting rate. The importance of this is that the system can determine if there is an adequate flow rate available for the printhead 20 to function satisfactorily at a given jetting rate. The printer system can then decide on a jetting rate that will deliver ink at the available flow rate without reaching ink starvation. Therefore, the image printed by the user can be free of print defects, but at a lower print setting. Additionally, this method can be used to determine if the flow rate has decreased for a jetting rate higher than is used in the printer in order to predict that the ink remaining is low and the cartridge 38 will soon require replacement.

In order to determine the ink flow rate of a printer/cartridge, the printer 10 can be profiled offline. The slope of the rise in printhead temperature can also be determined for the case in which there is no ink flow. The decrease in ink flow can then be linearly approximated based on the slope of the rise in temperature. For example, if the slope is 10° C./sec for a zero ink flow situation, and a slope of 5° C./sec is observed, then it can be determined that the ink flow is 50% of nominal at the given jetting frequency. In practical terms, for this example, the printhead 20 will only be able to print with 50% of the nozzles 36. Therefore, based on the slope of the rise in temperature, the printer 10 can predict the amount of print defects that will be visible to the user by determining the number of nozzles 36 that are functioning.

Since this algorithm determines ink flow as a function of jetting frequency, the printer 10 can use the algorithm to determine if there is a sufficient ink flow available to print at a setting currently chosen by the user. If there is not enough ink flow available then the printer can warn the user, or preferable, automatically choose a setting in which there is a sufficient ink flow available so that all nozzles 36 will be able to function.

With integrated inkjet printheads, a common problem for users is that the protective tape removably attached to the bottom of the printhead 20 is not removed before inserting the printhead 20 into the printer 10. The tape covers the openings in the nozzle plate of the printhead 20 to prevent particulate matter from entering the nozzles 36, and keeps the ink in the nozzles 36 from drying out. In some cases, users attempt to remove the protective tape, but the pull tab separates from the sealing tape, leaving the printhead chip still sealed. According to a feature of the invention, described is a technique by which the printer 10 can detect the presence of tape still on the printhead 20 and alert the user of the error.

When the protective tape is left on the bottom of the printhead 20 when installed in the printer 10, no ink can be ejected from the nozzles 36. Thus, during use, the temperature of the printhead 20 becomes much hotter than a printhead 20 otherwise would during the same jetting operation. Therefore, when attempting to use a printhead 20 in a printer 10, where the printhead 20 is still taped, the ink flow is obviously very low, and most likely zero. According to a technique of the invention, the printer 10 can detect if the tape remains over the printhead nozzles 36.

Another common problem users experience is the depriming of a cartridge 38 or printhead 20 during shipping or storage. If this occurs, and the user installs the printhead 20 in the printer 10, there will be no ink drawn from the cartridge 38, even though it is full, and no printing can be accomplished.

Figure 5:
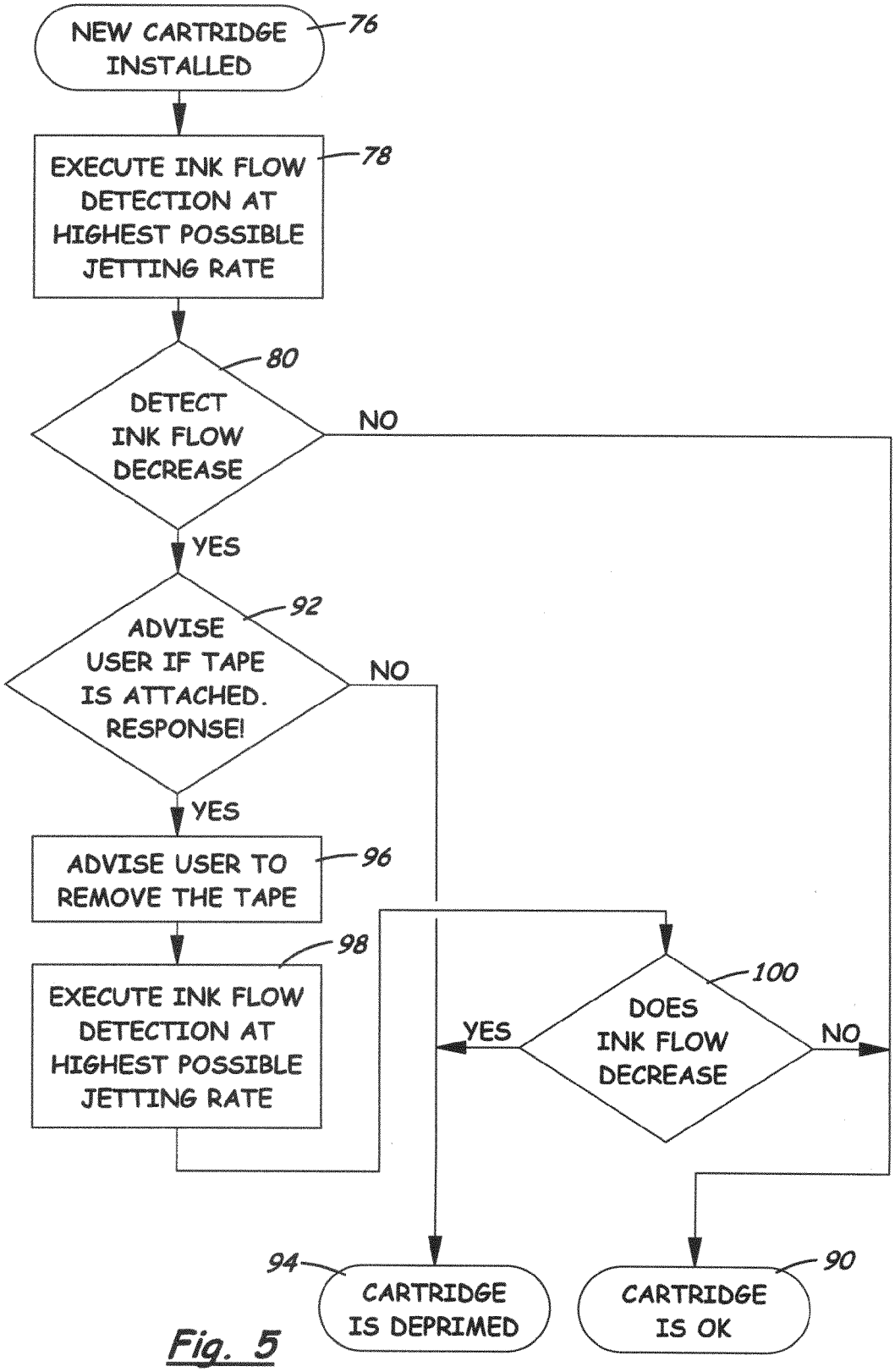
FIG. 5 is a flow chart of operations to determine if the printhead remains taped, or if the cartridge is deprimed.

Therefore, in order to determine if depriming has occurred, or if the printhead 20 is still taped, the printer 10 can be programmed with a technique to determine ink flow when the cartridge 38 is first installed in the printer 10. The operations for accomplishing this technique are illustrated in FIG. 5.

In program flow block 76, a new ink cartridge/printhead is installed in the printer 10. After the cartridge 38 is installed in the printer 10, an ink flow detection test is executed at the highest jetting rate possible for the printer 10. This is shown in block 78. The testing of the flow rate of ink jetted from a printhead is the same as described in connection with FIGS. 2 and 3, namely determining the slope of the rise in printhead temperature as compared to a nominal flow rate for that type of printhead. In program flow decision block 80, it is determined if there was a decrease in the flow of ink as a result of jetting the nozzles 36 at the highest rate permitted by the printer 10 and/or the printhead 20. If there was no decrease in the flow rate of the ink, then processing branches from decision block 80 to block 90 where the ink cartridge 38 is considered operational. In other words, if the temperature of the printhead 20 did not substantially increase (because a sufficient ink flow provided a cooling effect), then the ink flow did not decrease. As such, the cartridge 38 works as intended.

If, on the other hand, the ink flow rate did decrease as found in decision block 80, then processing branches to decision block 92. Here, the user of the printer 10 is advised to determine if the protective tape is still covering the nozzles 36 of the printhead 20. The user can be prompted through instructions coupled from the printer 10 to the host device controlling the printer 10. Alternatively, the printer 10 can itself provide visual indications by way of a readout located on the printer 10. In response to a negative input from the user, via the host device or the printer itself, then processing proceeds to program flow block 94, where the user is advised that the cartridge is deprimed and must be either replaced, or further operated according to the algorithm (block 98), or other maintenance operations, in an attempt to prime the flow of ink therein.

If the user had returned a positive response to the inquiry in decision block 92, meaning that the cartridge 38 is still taped, then the user is advised to remove the tape. Then, the printer 10 re-executes the flow rate detection test at the highest possible jetting rate, as shown in program flow block 98. If the ink flow rate did not decrease, then according to decision block 100, the cartridge is considered operational, as noted in block 90. If a decrease in ink flow was found in decision block 100, then processing branches to block 94 where the user is advised that the cartridge 38 has become deprimed and must be replaced. A cartridge 38 that has lost its ink prime means that there is an interruption in the liquid ink path, such as a bubble or clogging, and ink cannot be withdrawn from the cartridge 38. From the foregoing, the problems of cartridge 38 being deprimed or taped can be determined by using the ink flow test of the invention described in FIGS. 2 and 3.

Figure 6:
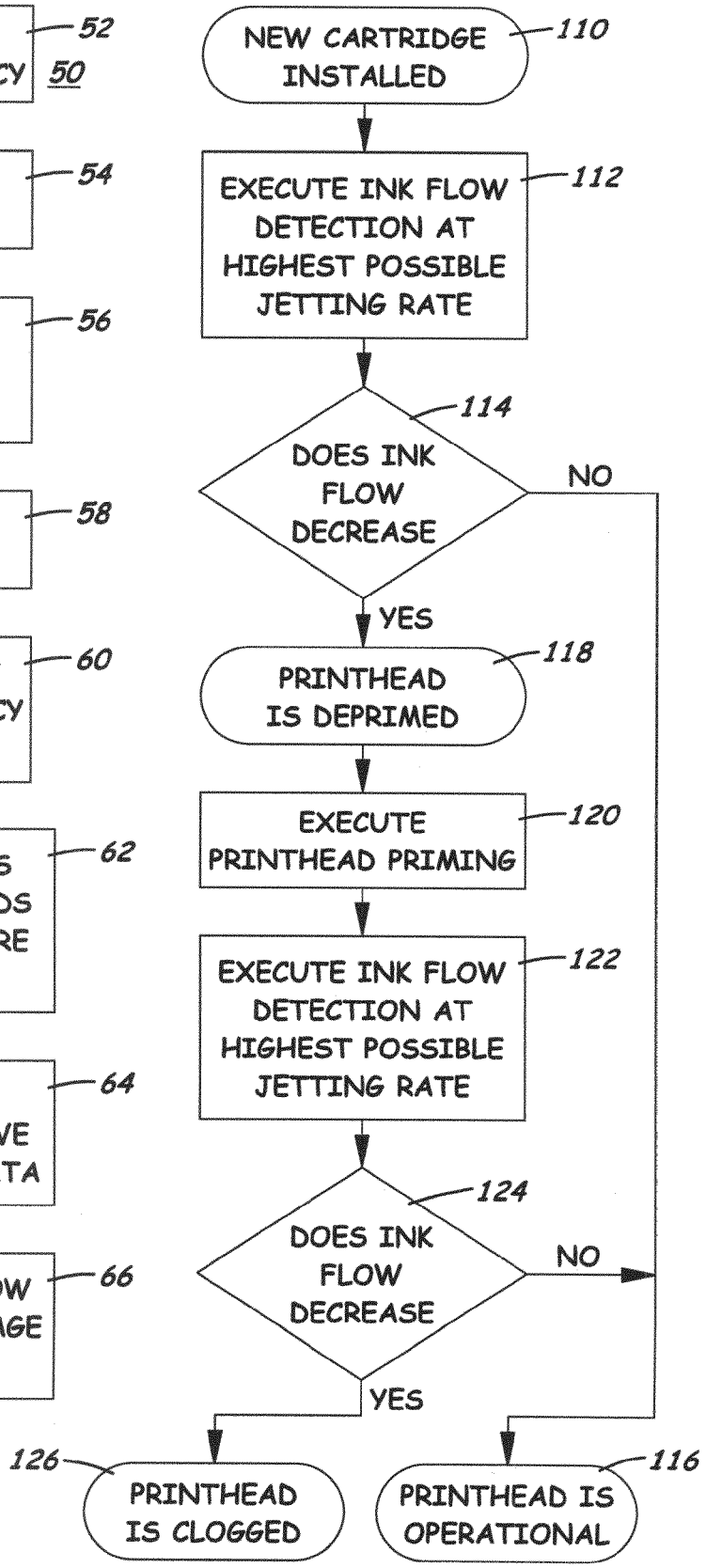
FIG. 6 is a flow chart of operations to determine ink flow detection in a printer with a new ink cartridge.

There are three printhead 20 states that are of interest, namely, an out of ink cartridge 38, a deprimed printhead or a clogged printhead. FIG. 6 shows the process for determining whether the state of a new cartridge 38 is deprimed or clogged during or after cartridge installation. Once a new cartridge 38 is installed (block 110), the ink flow is measured at the highest jetting frequency, as shown in block 112. If there is less than full ink flow, i.e., a decrease in the flow rate, the printhead 20 is considered deprimed (block 118). Next, the printer 10 can carry out a priming process in which an attempt is made to prime the flow of ink to allow it to be withdrawn from the cartridge 38. This is shown in block 120. The ink flow test is again carried out at the highest jetting rate (block 122). If the ink flow is found to be normal (block 124), then the printhead 20 is considered operational, as shown in block 116. If the ink flow is found to have decreased in decision block 124, then the printhead 20 is considered clogged. The conclusion of a clogged printhead is shown in block 126. The maintenance mode of the printer 10 can be entered to carry out printhead jetting in an attempt to clear any clogging of either the printhead nozzles 36 or the cartridge 38.

Figure 7:
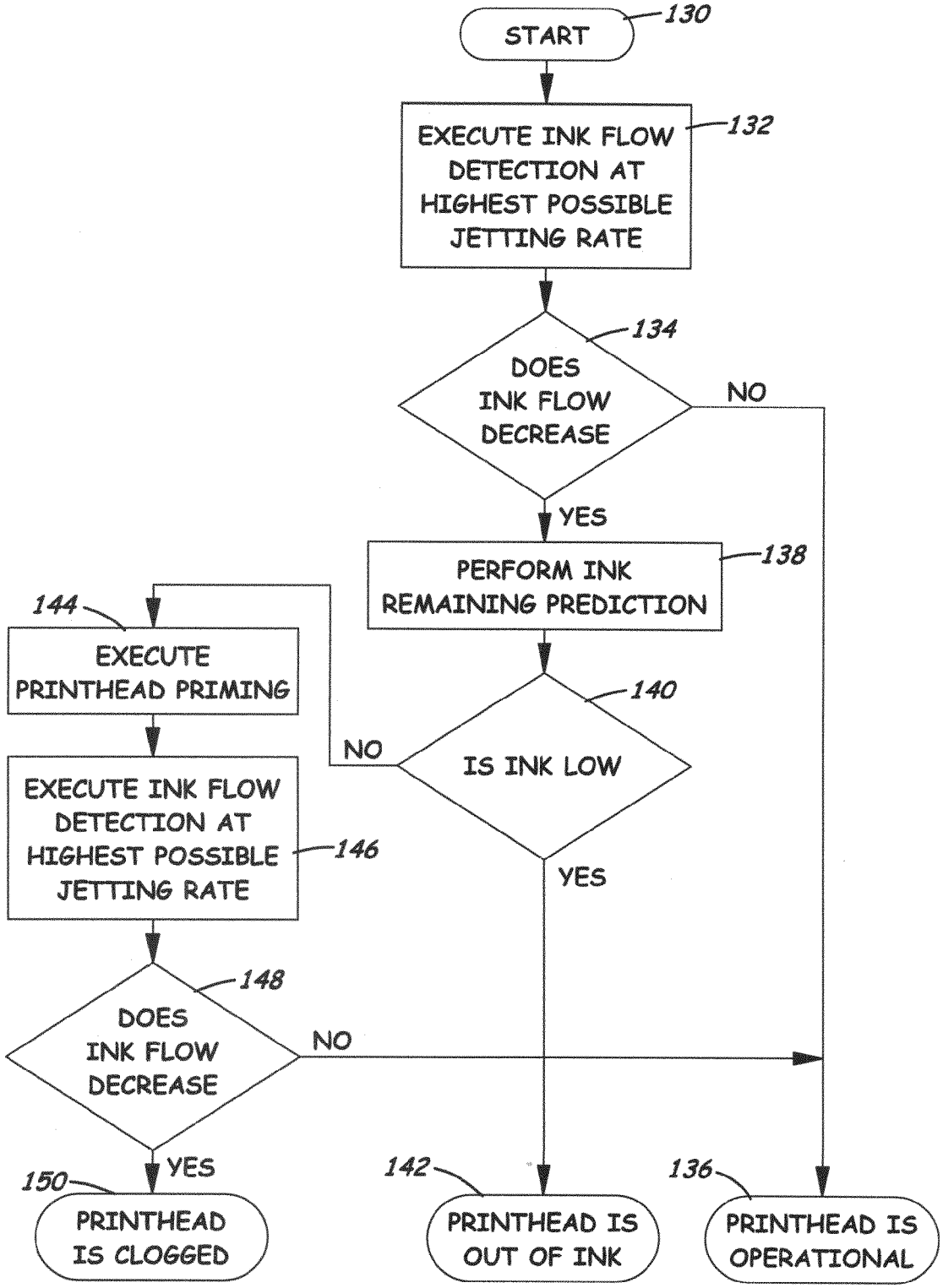
FIG. 7 is a flow chart of operations to determine ink flow detection in a printer with a used ink cartridge.

FIG. 7 shows a technique according to a feature of the invention for determining whether a used ink cartridge is either deprimed, clogged or out of ink. At the start 130 of the technique shown by the algorithm, ink flow is detected at the highest jetting frequency (block 132). Again, the detection of ink flow from the cartridge 38 can be determined by the algorithm described above in connection with FIGS. 2 and 3. In the event it is found that the ink flow is normal for the jetting operation, then processing branches to block 136 where it can be concluded that the ink cartridge 38 is operational. If, on the other hand, there is less than a normal ink flow under the circumstances, as noted in decision block 134, then the ink remaining predictor in block 138 determines if the cartridge 38 is low on ink. As noted above, the determination that a cartridge 38 is out of ink can be made by carrying out the operations of FIG. 2 where the temperature of the printhead 20 increases during the burst of nozzle firings. If it is found that the cartridge 38 has no ink, processing branches to block 142. Otherwise, the printhead 20 will be primed by the printer 10 by the operations noted in block 144. Then, the printhead 20 is operated at the highest jetting rate to determine the ink flow, as noted in blocks 146 and 148. Again, if the ink flow did not decrease after attempts to prime the printhead 20, then it is concluded that the printhead 20 is operational (block 136). If, as a result of the priming operation and the increased jetting rate of blocks 144 and 146, it is found that the ink flow decreased, then it is concluded that the printhead 20 is clogged (block 150).

From the foregoing, disclosed is a technique for determining the flow rate of the ink as a function of jetting frequency and printhead temperature. Summarized, for a specific nozzle jetting frequency, the steady state jetting temperature of the printhead 20 is determined. Then, the ink flow rate is determined as a percentage of the nominal flow rate. If there is a rise in temperature, then the flow rate has decreased from the normal flow rate. If the slope of the rise in temperature is above a predefined limit, then there is no ink flow.

In accordance with other features of the invention employing the ink flow rate algorithm, it can be determined if the protective tape has been inadvertently left on the cartridge, or the cartridge has become deprimed. According to other features of the invention, it can be determined if there is sufficient ink flow to print at a desired print setting. If there is insufficient ink in the cartridge to support an ink flow rate at high speed printing, then the system can select a print setting that will support the available ink flow for printing with fewer nozzles. This feature extends the life of the ink cartridge and allows maximum usage of the ink in the cartridge. A much better prediction of when the cartridge will be out of ink can be made, as well as a more accurate determination of whether the cartridge is out of ink. According to yet other features of the invention, a better determination can be made whether either a permanent or semi-permanent printhead is deprimed or clogged.

The foregoing techniques can be carried out with thermal ink jet printers of many types, including printers employing replaceable printheads, as well as permanent and semipermanent printheads. A semipermanent printhead is the type that can be easily replaced by the user, but may not be recommended by the manufacturer. Semi-permanent printheads are often utilized in print systems using replaceable carrier ink tanks. A permanent printhead, on the other hand, is not replaceable, but if found to be defective according to the foregoing, the entire printer must be replaced.

While an embodiment is described above in connection with a thermal inkjet printer, the techniques and methods of the invention can be employed in many other types devices that jet a liquid, which may or may not be ink, through a nozzle. In addition, while the various states of the printhead can be determined by the liquid flow rate through the printhead, those skilled in the art will find that the technique can be utilized in determining yet other parameters relevant to the operation of the printhead.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A method of determining a status of a micro-fluidic ejection device, comprising:

selecting a jetting frequency of the micro-fluidic ejection device having a steady state temperature when operated at the selected jetting frequency;

heating the micro-fluidic ejection device to the steady state temperature;

jetting a fluid from the micro-fluidic ejection device with a burst at the selected frequency;

measuring the temperature change in the micro-fluidic ejection device as a result of the jetting burst; and determining a flow rate of the fluid though the micro-fluidic ejection device from the change in temperature as a result of the jetting burst, wherein if the measure temperature dictates that fluid remains in the micro-fluidic ejection device, the determined flow rate is a first flow rate adjusted to jet less than all available nozzles of the micro-fluidic ejection device or is a second flow rate lower than the first flow rate jetting all said available nozzles of the micro-fluidic ejection device.

2. The method of claim 1 further including jetting a plurality of nozzles associated with the micro-fluidic ejection device during the jetting burst.

3. The method of claim 1 further including carrying out the jetting burst for a predetermined period of time.

4. The method of claim 1 further including waiting a predetermined period of time after the jetting burst before measuring the micro-fluidic ejection device temperature.

5. The method of claim 1 further including capturing temperature samples from the micro-fluidic ejection device for a predetermined period of time after the jetting burst.

6. The method of claim 1 further including determining the fluid flow rate as a function of a slope of the change in temperature.

7. The method of claim 6 further including comparing a reference slope of a reference fluid flow with a slope calculated from measuring samples of micro-fluidic ejection device temperatures, and determining a fluid flow based on a difference between the reference slope and the calculated slope.

8. The method of claim 1 further including determining the fluid flow rate when a new fluid supply is installed.

9. The method of claim 1 further including predicting an amount of print defects that occur during imaging at the first flow rate using said less than all available nozzles of the micro-fluidic ejection device.

10. The method of claim 1 further including determining a fluid flow rate to determine if the micro-fluidic ejection device is clogged.

11. The method of claim 1 further including determining a fluid flow rate to determine if the micro-fluidic ejection device is deprimed.

12. The method of claim 1 further including determining a fluid flow rate to determine if the fluid supply is low.

13. The method of claim 1 further including determining a fluid flow rate to determine if one or more nozzles associated with the micro-fluidic ejection device are obstructed.

* * * * *